US012642340B2

(12) United States Patent
Sun

(10) Patent No.: US 12,642,340 B2
(45) Date of Patent: Jun. 2, 2026

(54) EFFICIENT NAIL DUST EXTRACTOR

(71) Applicant: Dongguan Pinchuang Zhizhen Technology Co., Ltd., Dongguan (CN)

(72) Inventor: Jinghui Sun, Shenzhen (CN)

(73) Assignee: Dongguan Pinchuang Zhizhen Technology Co., Ltd., Dongguan (CN)

( * ) Notice: Subject to any disclaimer, the term of this patent is extended or adjusted under 35 U.S.C. 154(b) by 347 days.

(21) Appl. No.: 18/360,872

(22) Filed: Jul. 28, 2023

(65) Prior Publication Data

US 2025/0031829 A1 Jan. 30, 2025

(51) Int. Cl.
*A45D 29/00* (2006.01)
*A47L 7/00* (2006.01)

(52) U.S. Cl.
CPC ..... *A45D 29/00* (2013.01); *A47L 7/0066* (2013.01)

(58) Field of Classification Search
CPC ..... A47L 7/0066; A47L 7/0095; A47L 5/14; A47L 9/1683
See application file for complete search history.

(56) References Cited

U.S. PATENT DOCUMENTS

2006/0260628 A1* 11/2006 Chan ..... A45D 29/00 132/73
2020/0037837 A1* 2/2020 Hsieh ..... A47L 7/0047
2021/0298551 A1* 9/2021 Cheng ..... A47L 7/0085

* cited by examiner

*Primary Examiner* — Andrew A Horton
(74) *Attorney, Agent, or Firm* — JEEN IP LAW, LLC

(57) ABSTRACT

An efficient nail dust collector is provided. A shell has a dust removal area connected to a dust suction device on an outside, and a blower device on the shell used to blow nail dust towards the dust removal area. Through the air pressure generated by the blower device, nail dust is pressed down to the dust removal area, and the dust suction device collects the nail dust from the dust removal area. The cooperation of the blower device and the dust suction device can effectively improve the dust removal effect, reduce the noise generated during the operation of the dust collector, and avoid affecting the health of consumers and workers. The structure is simple, convenient to use, and meets usage requirements.

7 Claims, 4 Drawing Sheets

EFFICIENT NAIL DUST EXTRACTOR

TECHNICAL FIELD

This present application relates to the field of nail dust extraction technology, specifically to an efficient nail dust extractor.

BACKGROUND

At present, with the continuous development of the beauty industry, nail care and nails have become part of the lifestyle of fashionable urban women. During the nail process, nail grinding is a basic procedure. However, this process generates a large amount of nail dust, which can easily float in the workplace and be inhaled by the human body, affecting the health of consumers and staff. To cater to the needs of nails without affecting human health, the existing technology uses a nail dust extractor to collect and process nail dust.

The majority of current nail dust collectors consist of a shell and a dust suction device located within the shell. The shell is specifically designed for nail dust collection and can comfortably support the hand during nail filing operations. The dust suction device within the shell generates suction through a motor that drives the fan blades, drawing nail dust into a filter net, thus completing the dust removal process.

Existing dust collectors, in order to improve dust removal efficiency, often increase the output power of the motor and the rotation speed of the fan blades to achieve greater airflow and thus better dust removal effects. However, this approach results in the fan blades generating significant noise during rotation, which affects the physical and mental health of consumers and employees. Moreover, existing dust collectors can only extract nail dust from the dust extraction area. During the nail filing process, if the operator accidentally lifts their hand, nail dust can appear at a higher position, far from the dust extraction area, leading to inefficient dust removal. This can easily cause nail dust to scatter and float in the workplace, affecting the health of consumers and employees, and failing to meet usage needs.

SUMMARY

In view of the defects of the existing technology, this present application provides an efficient nail dust extractor, which has a simple structure, is easy to use, can effectively improve the dust extraction effect, reduce the noise generated during the operation of the dust extractor, avoid affecting the health of consumers and staff, and meet usage requirements.

To achieve the above objectives, the technical scheme adopted by this present application is:

An efficient nail dust extractor, which includes a shell. The shell has a cavity. The upper end of the shell is equipped with several dust extraction holes connected to the cavity. A dust extraction device is set up in the cavity. Above the shell, there is a fan that blows downwards. When the fan rotates, it can generate downward wind pressure, pressing the nail dust down to the upper end of the shell, and the dust extraction device sucks the nail dust through the dust extraction holes.

In the above description, as a preferred option, the shell is equipped with an upward-extending flexible hose. One end of the hose is installed on the shell, and the other end of the hose is equipped with an installation bracket. The fan is installed on the installation bracket. The angle of the fan can be adjusted through the hose according to the specific usage angle of consumers and staff, ensuring the fan can always press the nail dust down to the upper end of the shell.

In the above description, as a preferred option, the shell is equipped with a circuit board and a battery. The circuit board is electrically connected to the battery, and the dust extraction device is electrically connected to the circuit board through a first connecting line.

In the aforementioned description, as a preferred option, an installation bracket is equipped with LED beads that illuminate downward. The fan and LED beads are connected to the shell via a second connecting wire. The fan and LED beads are electrically connected to the circuit board through the connecting wire. By setting up LED beads, focused illumination can be provided during the grinding process, achieving simultaneous grinding and dust removal effects.

In the above description, as a preferred option, the shell is equipped with adjustment buttons and switch keys. Both the adjustment buttons and switch keys are connected to the circuit board. The switch key is used to control the power on and off, and the adjustment button is used to adjust the gear of the fan.

In the aforementioned description, as a preferred option, a filter net is placed between the dust suction device and the dust extraction hole. The filter net can effectively filter nail dust.

In the aforementioned description, as a preferred option, the suction hole is located in the middle of the upper surface of the shell, and the upper surface of the shell is set to slope downward from the edge towards the middle, making the opening on the upper surface of the shell form a bowl-like shape.

In the aforementioned description, as a preferred option, the suction hole is located in the middle of the upper surface of the shell, and the upper surface of the shell is set to slope downward from the edge towards the middle, making the opening on the upper surface of the shell form a bowl-like shape.

The beneficial effects of this application include: The shell has a cavity, and several dust extraction holes connected to the cavity are set at the top of the shell. A dust suction device is installed within the cavity, and a fan that blows downward is located above or to the side of the shell. When the fan rotates, it generates a downward air pressure, pushing the nail dust towards the dust extraction area on the top of the shell. The dust suction device sucks in nail dust through the dust extraction holes. By adjusting the angle of the upper fan, the blower can always push the nail dust down to the dust extraction area, effectively improving the dust removal effect, reducing the noise generated during the operation of the dust collector, and protecting the health of consumers and employees. The structure is simple, easy to use, and meets usage needs.

With the above features, the present application provides an efficient solution for nail dust extraction in the nail industry. The overall design is aimed at improving the dust extraction efficiency while minimizing noise and health impacts on consumers and staff. The adjustable fan, LED beads for illumination, and convenient wrist pad make the device user-friendly and adaptable to different working scenarios. Furthermore, the filter net and dust collection bag ensure a clean working environment, reducing the risk of blockages and increasing the longevity of the device. Overall, this present application meets the practical needs of nail professionals and customers, providing an effective, convenient, and health-conscious solution for nail dust extraction.

Reference signs: 10—Shell, 11—Vacuum hole, 12—Opening, 13—Vacuum device, 14—Filter net, 15—Circuit board, 16—Battery, 17—USB interface, 18—Adjustment button, 19—Switch button, 20—Fan, 21—Flexible tube, 22—Installation bracket, 23—LED bead, 24—USB plug, 30—Wrist pad.

DETAILED DESCRIPTION

Figure 1:
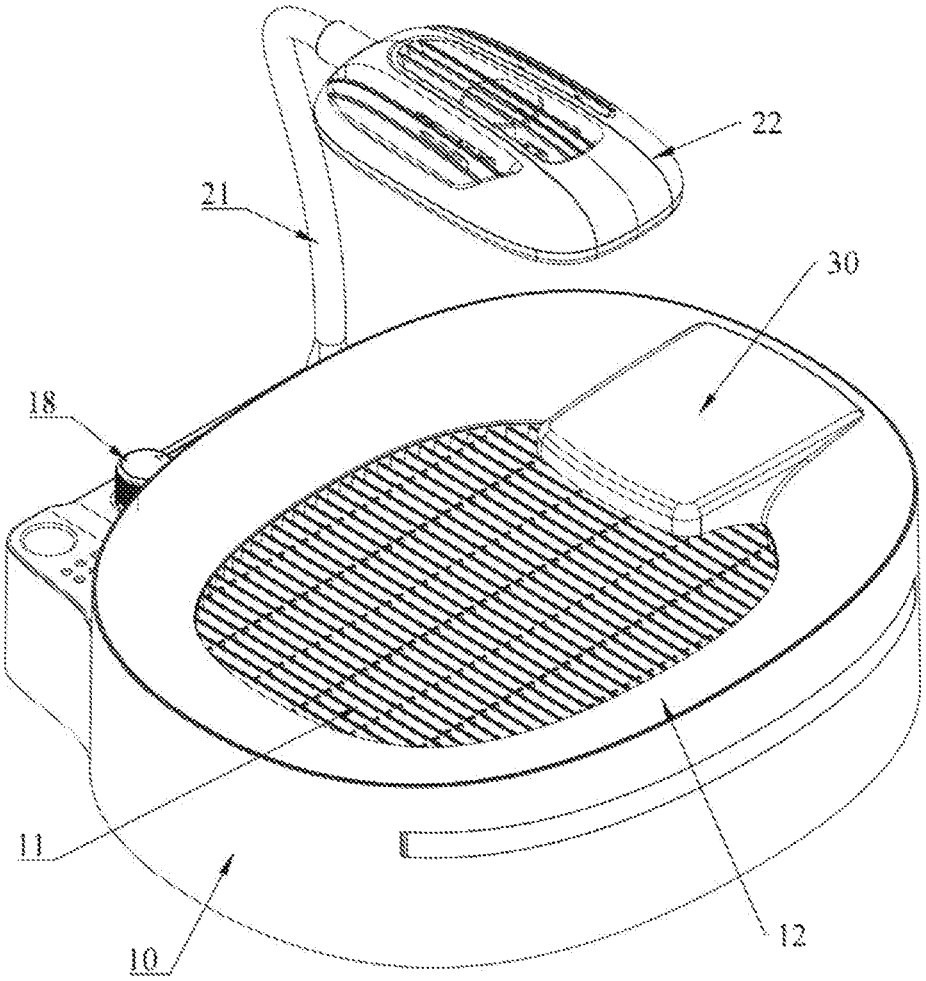
FIG. 1 is a schematic diagram of the structure of an embodiment of the present application.
Figure 2:
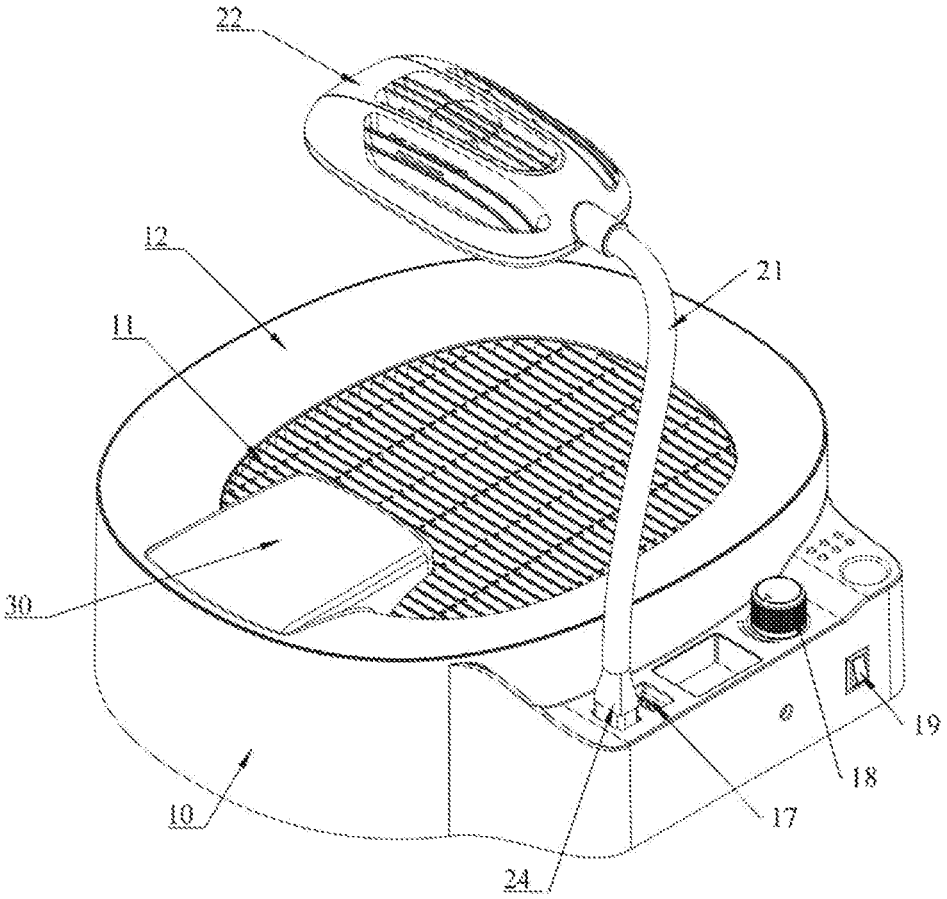
FIG. 2 is a schematic diagram of the rear view direction of an embodiment of the present application.
Figure 3:
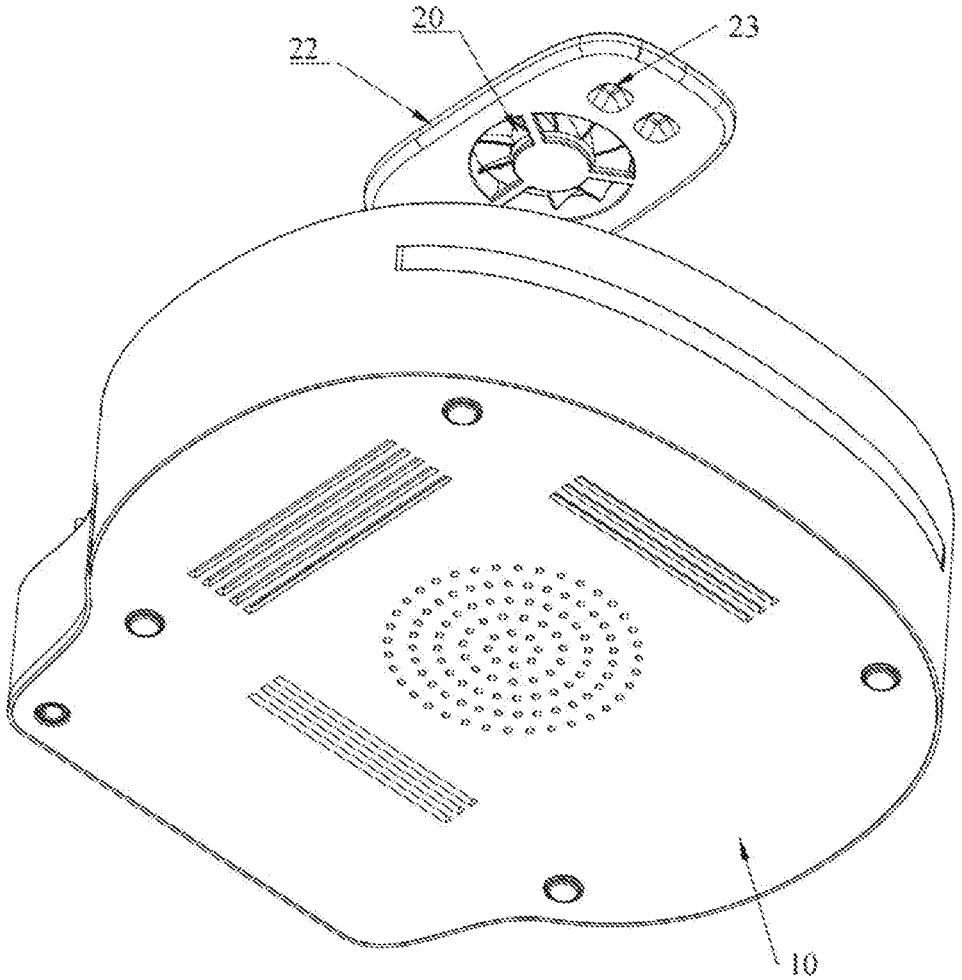
FIG. 3 is a schematic diagram of the bottom view direction of an embodiment of the present application.
Figure 4:
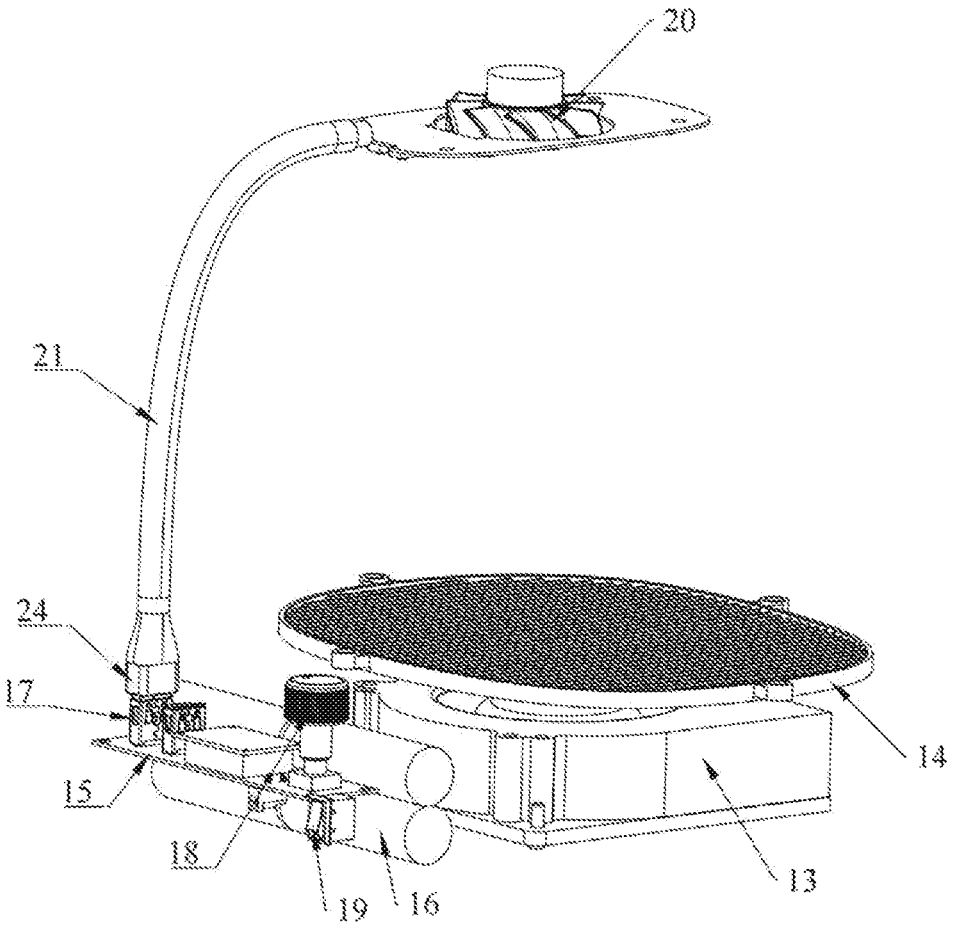
FIG. 4 is a schematic diagram of the internal structure of an embodiment of the present application.

To more clearly illustrate the structural features, technical means, and specific objectives and functions of the present application, the following provides further detailed explanations in conjunction with the attached drawings and specific examples:

In this embodiment: As shown in FIGS. 1-4, the efficient nail dust collector includes a shell 10, which has a cavity inside. The cavity houses a dust suction device 13, which is a vacuum fan. Several dust extraction holes 11 are set on the upper surface of the shell 10, and these holes are connected to the cavity. The dust extraction area is formed between these holes 11 and it includes the area within 15 cm of the dust extraction holes 11 and the upper end of the shell 10. The dust extraction holes 11 are located in the middle of the upper surface of the shell 10. The upper surface of the shell 10 slopes downwards from the edge towards the middle, forming a bowl-like opening 12. This design ensures that nail dust can conveniently fall into the dust extraction holes 11 when it is being sucked up. A filter net 14 is set between the dust suction device 13 and the dust extraction holes 11. A blower 20 is located on the upper part of the shell 10 and is used to blow nail dust towards the dust extraction area. The blower 20 is a fan that generates air pressure when it rotates, pushing the nail dust down to the dust extraction area. The dust suction device 13 creates negative pressure and sucks the nail dust into the filter net 14 through the dust extraction holes 11. The dust is then collected by the filter net 14. The shell 10 has an upwardly extending hose 21. One end of the hose 21 is installed on the shell 10, and the other end is equipped with an installation bracket 22. The blower 20 is installed on the installation bracket 22 and can adjust its angle through the hose 21. According to the specific usage angles of consumers and staff, the angle of the blower 20 can be adjusted so that it can always push the nail dust down to the upper surface of the shell 10. The edge of the upper surface of the shell 10 has a wrist pad 30 that extends over the dust extraction hole 11. By setting up the wrist pad 30, the hand can be placed over the dust extraction hole 11 for nail filing work. This allows the nail dust to fall directly into the dust extraction hole 11, improving the dust extraction effect.

The shell 10 houses a circuit board 15 and a battery 16. The circuit board 15 is electrically connected to the battery 16, and the dust suction device 13 is connected electrically to the circuit board 15. The installation bracket 22 is equipped with downward-facing LED beads 23 and a downward-facing blower outlet. Both the blower 20 and the LED beads 23 are electrically connected to the circuit board 15 through wires that pass through the hose 21. By setting up the LED beads 23, focused illumination can be provided during grinding, improving the efficiency of grinding. The shell 10 has an adjustment button 18 and a switch key 19. Both the adjustment button 18 and the switch key 19 are connected to the circuit board 15. The switch key 19 is used to control the power on and off, while the adjustment button 18 is used to adjust the rotation speed of the blower 20.

Through the coordination of the fan 20 and the dust suction device 13, the dust suction effect can be effectively improved, the noise generated during the operation of the dust extractor can be reduced, the health of consumers and workers can be protected, and the structure is simple, easy to use, and meets user needs.

The above description is only the preferred embodiment of the present application and should not limit the present application. Therefore, any modifications, equivalent replacements, and improvements made to the above embodiments according to the technical scheme of the present application are still within the scope of the technical scheme of the present application.

What is claimed is:

1. An efficient nail dust extractor, which includes a shell, wherein the shell has a cavity, several dust suction holes connected with the cavity are set on an upper end surface of the shell, a dust suction device is set in the cavity, and a downward blowing fan is set above the shell, wherein the dust suction device is a vacuum fan;

wherein the shell has an upwardly extending hose, one end of the hose is installed on the shell, the other end of the hose has an installation bracket, the fan is installed on the installation bracket, and the fan can adjust its angle through the hose.

2. The efficient nail dust extractor according to claim 1, wherein a circuit board and a battery are set inside the shell, the circuit board is electrically connected with the battery, and the dust suction device is electrically connected to the circuit board.

3. The efficient nail dust extractor according to claim 2, wherein the installation bracket is equipped with downward illuminating LED beads; the fan and LED beads are connected to the shell;

an interface is provided on the circuit board, and the fan and LED beads are electrically connected to the circuit board by inserting an electric wire plug into the interface.

4. The efficient nail dust extractor according to claim 2, wherein the shell is equipped with an adjustment button and a switch button, both the adjustment button and the switch button are connected to the circuit board.

5. The efficient nail dust extractor according to claim 1, wherein a filter net is set between the dust suction device and the dust suction holes.

6. The efficient nail dust extractor according to claim 1, wherein the dust suction holes are set in a middle of an upper end surface of the shell, and the upper end surface of the shell is inclined downward from an edge toward a middle, forming a bowl-shaped opening on the upper end surface of the shell.

7. The efficient nail dust extractor according to claim 1, wherein an upper end surface edge of the shell is equipped with a wrist pad, the wrist pad extends above the dust suction holes.

* * * * *